United States Patent [19]

Handler

[11] Patent Number: 4,884,713

[45] Date of Patent: Dec. 5, 1989

[54] ARTICLE ORGANIZING DEVICE EMPLOYING HOOK AND LOOP FASTENING MATERIAL

[75] Inventor: Michael D. Handler, Norwalk, Conn.

[73] Assignee: Velcro Industries, B.V., Amsterdam, Netherlands

[21] Appl. No.: 249,278

[22] Filed: Sep. 22, 1988

Related U.S. Application Data

[63] Continuation of Ser. No. 893,386, Aug. 5, 1986, abandoned.

[51] Int. Cl.[4] ..... B65D 21/02; B65D 71/00

[52] U.S. Cl. ..... 220/23.4; 24/306; 206/806; 206/504; 211/131; 248/205.2

[58] Field of Search ..... 220/23.4, 23.6, 23.83, 220/23.86; 206/387, 504, 806, 813; 24/30; 248/205.2; 297/DIG. 6; 312/105; 211/131, 163, 168, 169, 166

[56] References Cited

U.S. PATENT DOCUMENTS

| | | | |
|---|---|---|---|
| 1,638,073 | 8/1927 | Van Heusen . | |
| 2,728,480 | 12/1955 | Close . | |
| 3,063,749 | 11/1962 | Strable | 297/DIG. 6 |
| 3,164,259 | 1/1965 | De'Caccia | 211/131 |
| 3,176,364 | 4/1965 | Dritz . | |
| 3,192,306 | 6/1965 | Skonnord . | |
| 3,251,399 | 5/1966 | Grossman . | |
| 3,338,291 | 8/1967 | Kintner | 24/306 |
| 3,413,656 | 12/1968 | Vogliano et al. . | |
| 3,475,810 | 11/1969 | Mates . | |
| 3,491,486 | 1/1970 | Caruth . | |
| 3,512,318 | 5/1970 | Turner . | |
| 3,668,808 | 6/1972 | Perina . | |
| 3,696,472 | 10/1972 | Perina et al. . | |
| 3,745,709 | 7/1973 | Perina . | |
| 3,747,754 | 7/1973 | Nix | 220/23.4 |
| 4,098,402 | 7/1978 | Rogg . | |
| 4,534,473 | 8/1985 | Post | 211/131 |
| 4,548,375 | 10/1985 | Moss | 248/205.2 |

FOREIGN PATENT DOCUMENTS

| | | | |
|---|---|---|---|
| 682583 | 3/1964 | Canada | 211/169 |
| 2612773 | 10/1976 | Fed. Rep. of Germany . | |
| 8626321 | 1/1987 | Fed. Rep. of Germany . | |
| 2565812 | 12/1985 | France | 220/23.83 |

*Primary Examiner*—George E. Lowrance

*Attorney, Agent, or Firm*—Hayes, Soloway, Hennessey & Hage

[57] ABSTRACT

An article organizer having article-holding components releasably attached to a central base member by hook and loop fastening material operating in shear. The organizer has a central base member adapted to sit on a desk, table, or the like. A vertical mounting member is carried by the base member for pivotal motion about a vertical axis. A first portion of a hook and loop fastening system is carried by the vertical mounting member on a plurality of attachment fins. A plurality of article-holding components are provided for mounting on the attachment fins. The component each including hook and loop mounting means for interacting with the first portion to releasably attach the components to the first portion in shear.

13 Claims, 4 Drawing Sheets

ARTICLE ORGANIZING DEVICE EMPLOYING HOOK AND LOOP FASTENING MATERIAL

This is a continuation of co-pending application Ser. No. 893,386 filed on Aug. 5, 1986 now abandoned.

BACKGROUND OF THE INVENTION

The present invention relates to post-mounted organizational devices and, more particularly, to an article organizer having article-holding components releasably attached to a central base member and comprising a central base member adapted to sit on a desk, table, or the like; a vertical mounting member carried by the base member; a first portion of a hook and loop fastening system carried by the vertical mounting member; and, a plurality of article-holding components for mounting on the vertical member, the components, each including hook and loop mounting means for interacting with the first portion to releasably attach the components to the first portion in shear.

Organizational devices are well known in the art. For foodstuffs, there is the well-known Lazy Susan device wherein a rotating shelf sits on a base. Individual containers sit on the shelf to hold the various food articles being organized. Often, the shelf is provided with indentations, or the like to hold containers specially made to be used therewith. In the work environment, similar devices are available for organizing the various articles that accumulate on a desk such as paperclips, rubberbands and the like.

While such devices are known, there is no such device where a plurality of containers for organizing articles are securely but removably held to the main support. In all cases known to the Applicant herein, the containers either sit on or hook onto the main support and are, therefore, subject to loss and spillage, particularly when the device is moved.

Wherefore, it is the object of the present invention to provide an organizer for articles where a plurality of containers are securely but removably carried by a central support unit.

SUMMARY

The foregoing object has been achieved by the article organizer of the present invention comprising a central base member adapted to sit on a desk, table, or the like; a vertical mounting member carried by the base member; a first portion of a hook and loop fastening system carried by the vertical mounting member; and, a plurality of article-holding components for mounting on the vertical member wherein the components each include a second portion of hook and loop fastening system for interacting in shear with the first portion to releasably attach the components to the first portion.

According to one embodiment as disclosed hereinafter, the vertical mounting member is a vertical post; the first portion includes a plurality of vertical fins extending outward from the post and having the loop portion of the hook and loop fastening system on parallel outward facing surfaces of the outer edge thereof; and, the hook and loop mounting means of the components comprises a shear trap channel member having parallel facing surfaces of the hook portion of the hook and loop fastening system adapted to releasably receive the outer edges therebetween. Preferably in that embodiment, the vertical post is adapted to pivot with respect to the central base member about a vertical axis disposed longitudinally therethrough.

According to a second embodiment as disclosed hereinafter, the vertical mounting member is a vertical post; the first portion includes at least one Lazy Susan type disk mounted for rotation on the post, the disk having a plurality of vertical fins extending upward tangentially about the periphery thereof and having the loop portion of the hook and loop fastening system on parallel outward facing surfaces of the upper edge thereof; and, the hook and loop mounting means of the components comprises a shear trap channel member having parallel facing surfaces of the hook portion of the hook and loop fastening system adapted to fit over and releasably receive the upper edges therebetween.

DESCRIPTION OF THE PREFERRED EMBODIMENT

In my co-pending patent application entitled SHEAR TRAP HOOK AND LOOP FASTENING SYSTEM, filed on even date herewith and assigned to the common assignee of this application, I described an improvement to hook and loop fastening systems wherein a shear trap channel is employed to use the hook and loop fastening material "in shear" to provide a high holding strength. The shear trap channel, however, allows the hook and loop fastening materials to be disengaged easily when necessary. The teachings of that co-pending application are hereby incorporated herein by reference and, accordingly, only a cursory description of the basic invention as incorporated into this invention will be provided.

Figure 1:
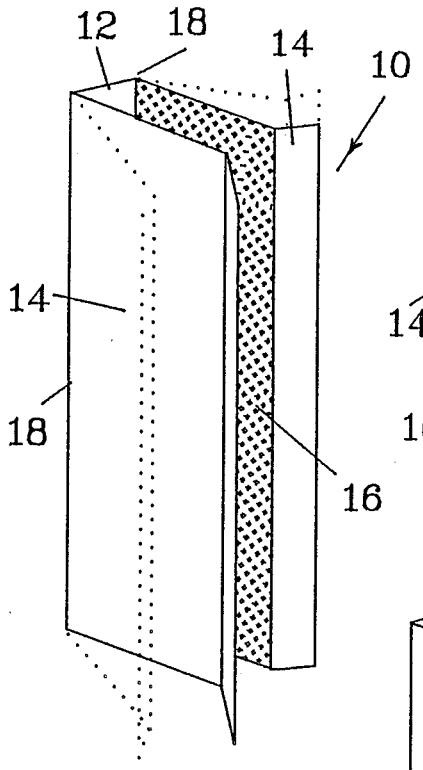
FIG. 1 is a perspective view of a vertically oriented shear trap channel as employed in the present invention.
Figure 2:
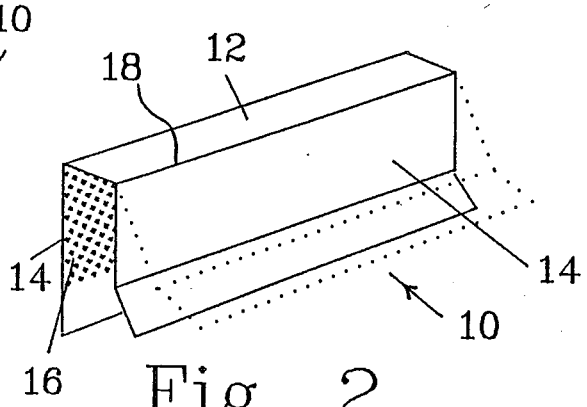
FIG. 2 is a perspective view of a horizontally oriented shear trap channel as employed in the present invention.

Turning briefly to FIGS. 1 and 2, the shear trap channels are shown in simplified form. In both cases, the shear trap channel is indicated as 10 and comprises a back portion 12 from which two parallel, spaced side portions 14 extend. In the preferred embodiment, the trap channels 10 are made of resiliently rigid plastic and the hinges described with relation thereto are so-called "living hinges" formed into the plastic material. In the embodiment of FIG. 1, both side portions 14 are hingedly attached to the back portion 12 such that both can swing outward, as indicated by the dotted ghost lines, for release of the hook and loop fastening materials employed therewith. Attachment of something to be fastened therewith is made to the back portion. In the embodiment of FIG. 2, only the one side portion 14 is hingedly attached to the back, as indicated by the single dotted ghost line. Attachment to this embodiment is made to either the back portion 12 or the other side portion 14. In the preferred embodiment, the facing inner surfaces of the side portion 14 have the hook portion 16 of hook and loop type fastening material thereon. The living hinges are indicated in both cases as 18. Thus if a planar member (not shown) having the loop material on outward facing parallel surfaces is inserted between the side portions 14, the planar member will be maintained therein with the hook and loop material operating "in shear". By swinging the side portions 14 outward, however, the hook and loop materials can be progressively released to allow the planar member to be withdrawn.

The basic principal of the present invention is the use of hook and loop fastening material, such as that sold by the assignee of the present invention under the trademark Velcro, in shear so as to have high gripping ability with the ability to release the materials easily when required. Accordingly, the shear trap channel construction of FIGS. 1 and 2 is employed to releasably fasten containers to a central support structure.

Figure 4:
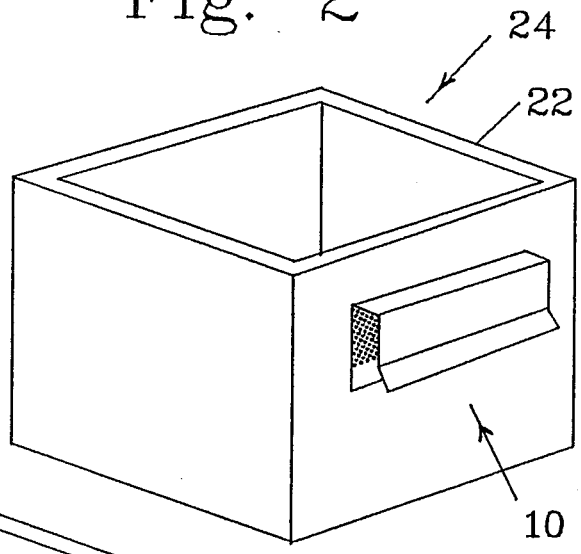
FIG. 4 is a perspective view of a container as employed in the present invention utilizing the shear trap channel of FIG. 2.
Figure 3:
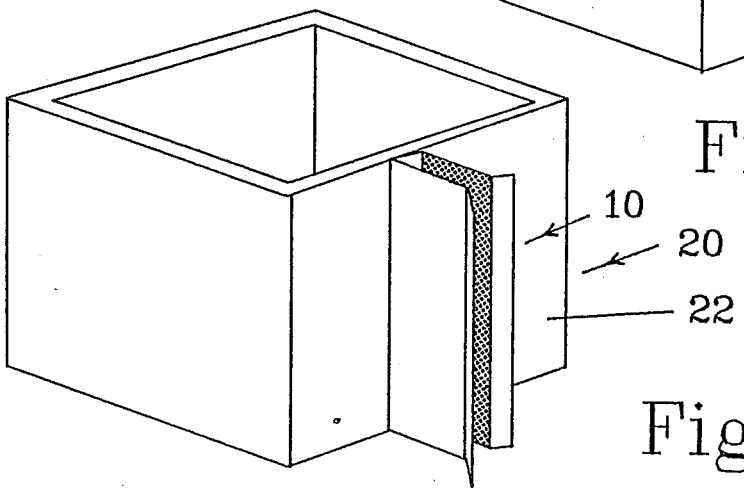
FIG. 3 is a perspective view of a container as employed in the present invention utilizing the shear trap channel of FIG. 1.

The two types of basic containers employed in the two embodiments of the present invention to be described hereinafter are shown in FIGS. 3 and 4, respectively. The shapes and types of the actual containers employed in a commercial embodiment can, of course, vary from the very basic shapes shown in the drawing of this application. For example, in most instances it will be desirable to have the adjacent sides of the ontainers shaped to fit close adjacent one another to maximize the holding capacity in a given area of space to be occupied. The container 20 of FIG. 3 comprises a box 22 having a strip of shear trap channel 10 of the double opening type shown in FIG. 1 vertically disposed on one side which is to serve as the "back" thereof. In the preferred embodiments of the present invention, the components are made of a smooth, tough, resilient plastic and, therefore, it is convenient to attach the shear trap channel strips with peel and stick adhesive, or the like. The container 24 of FIG. 4 also comprises a box 22; but, in this case, there is a strip of single opening shear trap channel 10 of the type shown in FIG. 2 attached to the "back" side of the box in a horizontal downward facing position.

Figure 5:
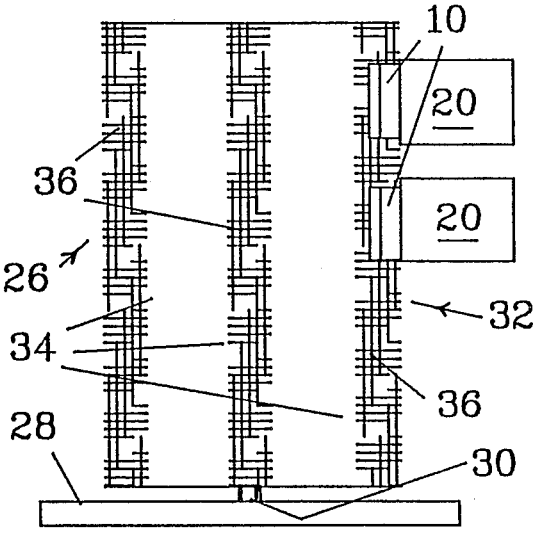
FIG. 5 is a side elevation of the central support structure of the present invention in a first embodiment as intended for use with containers such as that of FIG. 3.
Figure 6:
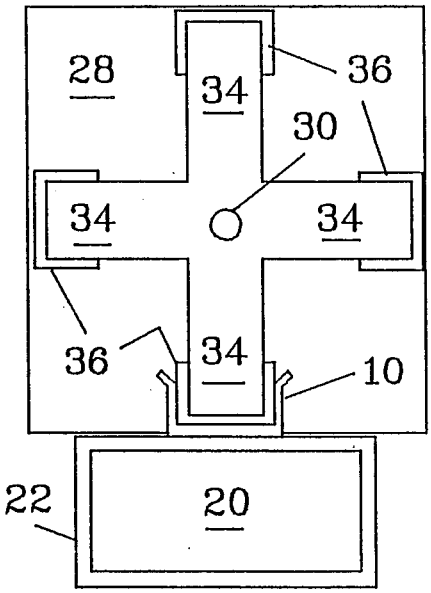
FIG. 6 is a top view of the support of FIG. 5.
Figure 7:
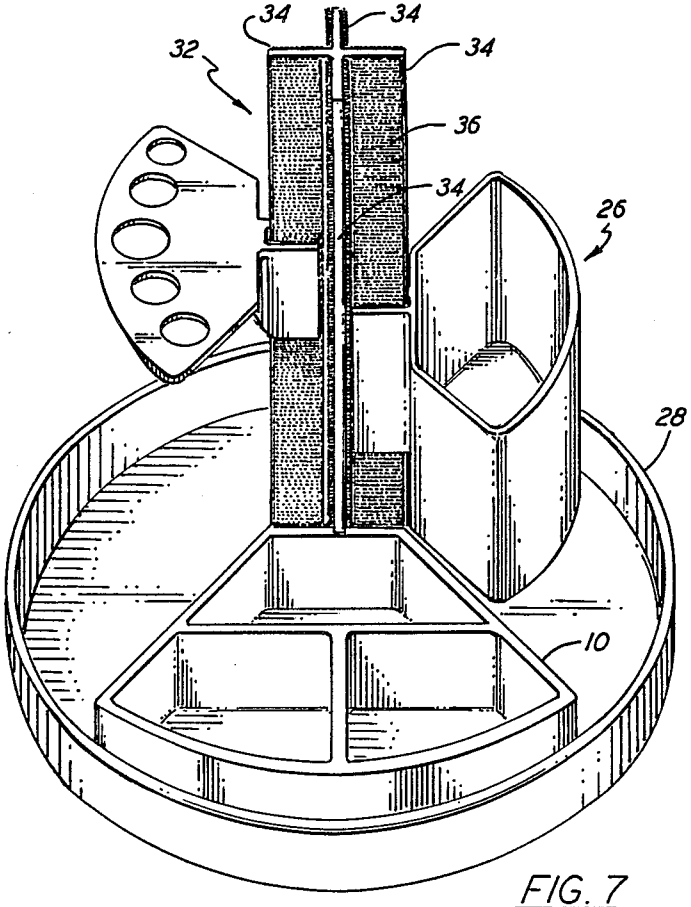
FIG. 7 is a view of the embodiment of FIGS. 5 and 6 with different shaped containers.

The preferred support structure for use with a plurality of containers 20 as shown in FIG. 3 is shown in FIGS. 5, 6 and 7 and generally indicated as 26. Support structure 26 comprises a base 28 having a center post 30 extending perpendicularly upward therefrom. A support member 32 is pivotally mounted on the post 30. The support member 32 has a plurality of vertical fins 34 extending outward from the center to which the containers 20 can be releasably attached. To permit attachment with the shear trap channels 10, the outer edge of each of the fins 34 has the loop portion 36 of the Velcro material attached thereto as with adhesive. The loop portions 36 needs to be on the opposed faces of the outer edge of each fin 34; so, the easiest way of applying it is to fold a strip of the material having adhesive backing thereon over the outer edge of the fin 34.

Figure 8:
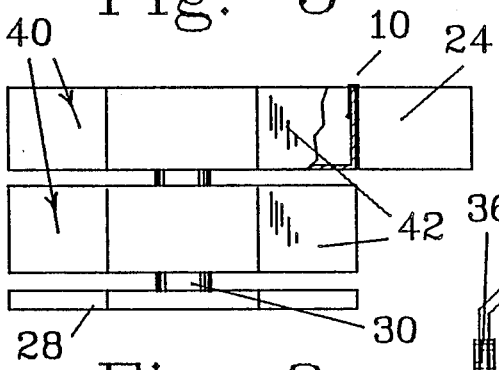
FIG. 8 is a side elevation of the central support structure of the present invention in a second embodiment as intended for use with containers such as that of FIG. 4.
Figure 9:
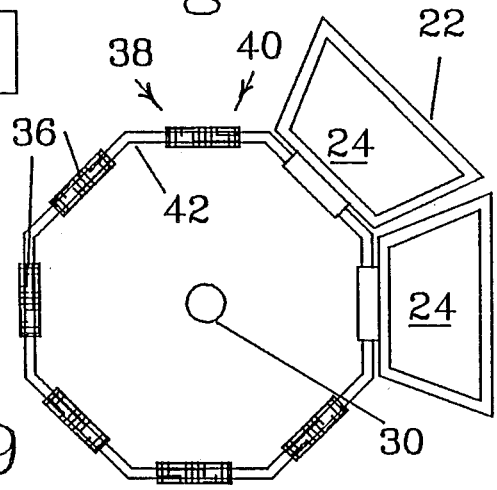
FIG. 9 is a top view of the support of FIG. 8.

The preferred support structure for use with a plurality of containers 24 as shown in FIG. 4 is shown in FIGS. 8 and 9 and generally indicated as 38. Support structure 38 again comprises a base 28 having a center post 30 extending perpendicularly upward therefrom. A Lazy Susan type support member 40 is pivotally mounted on the post 30. The support member 40 has a plurality of vertical fins 42 extending upward along the outer periphery to which the containers 24 can be releasably attached. To permit attachment with the shear trap channels 10, the top edge of each of the fins 42 has the loop portion 36 of the Velcro material attached thereto as with adhesive. The loop portion 36 needs to be on the opposed faces of the upper edge of each fin 42; so, as with the fins 34, the easiest way of applying it is to fold a strip of the material having adhesive backing thereon over the upper edge of the fin 42.

Figure 11:
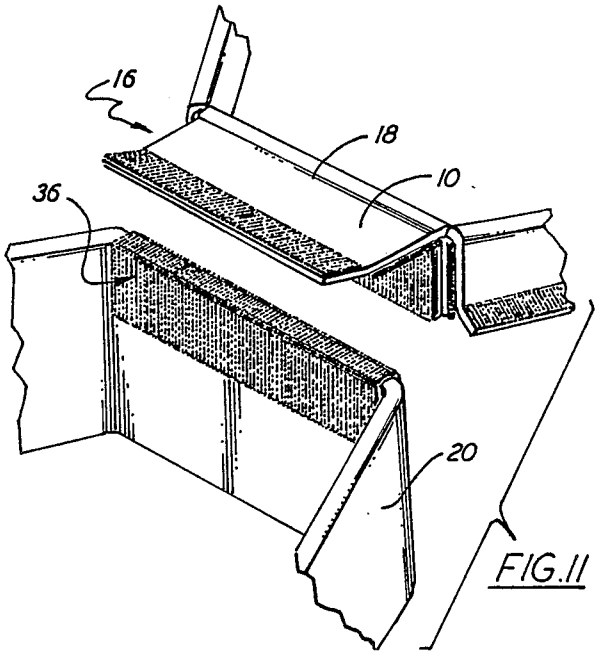
FIG. 11 is an enlarged portion of the arrangement of FIG. 10 showing the shear trap method of mounting containers in this variation.
Figure 10:
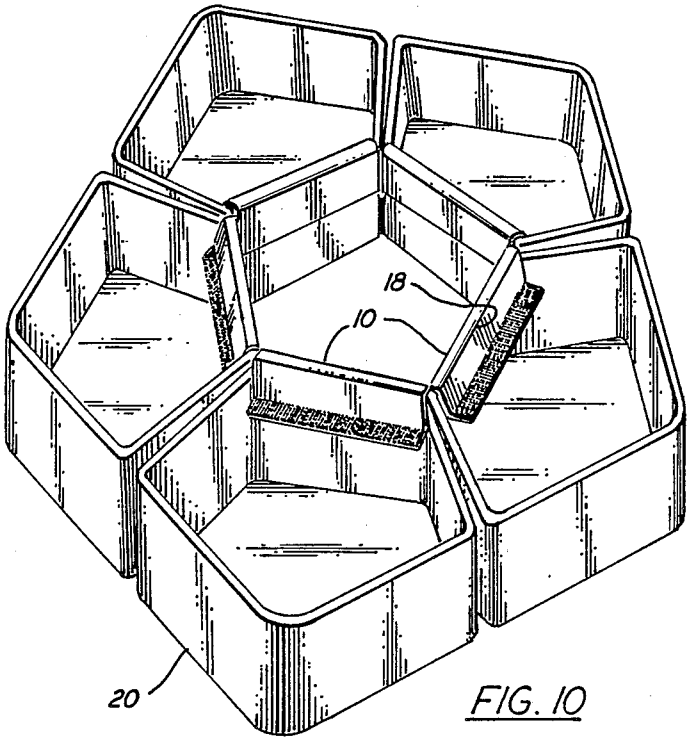
FIG. 10 is a variation of the embodiment of FIG. 8.

FIGS. 10 and 11 illustrate a variation of the support structure of FIGS. 8 and 9. Based on the Lazy Susan type support with a container support in the form of a pentagon mounted for rotation on a post (not shown) extending from the base (not shown) similar to those shown in FIGS. 8 and 9. Each side of the pentagon carries a shear channel 10 having a living hinge 18 and with the opening of the channel facing downwardly. A container 20 for mounting to the pentagon carries loop material 36 on opposed surfaces of one wall portion for engagement in the shear trap channel as shown. It will be appreciated that a stacked plurality of pentagons may be supported from a base and that the concept is not limited to the use of a pentagon.

Figure 12:
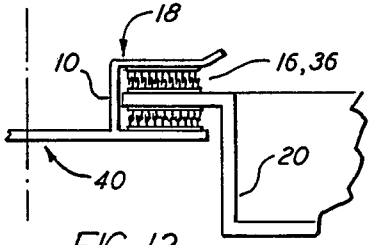
FIG. 12 is another arrangement for mounting containers on a support.

FIG. 12 illustrates a variation of the Lazy Susan concept for using shear trap channels to support containers on a turntable. In this case the shear trap channels 10 face outwardly from a turntable 14 with each channel having a living hinge 18 to permit the upper side of that channel to be hinged relative to the remainder of the channel to allow progressive separation of the hook and loop material 16, 36 by which a container is supported in the channel with the hook and loop materials in shear.

Thus, it can be seen that either of the above-described embodiments provides a pivoting support structure to which a plurality of containers can be easily attached and detached wherein the containers, when attached, are securely held in place by the Velcro hook and loop fastening materials operating in shear.

Figure 13:
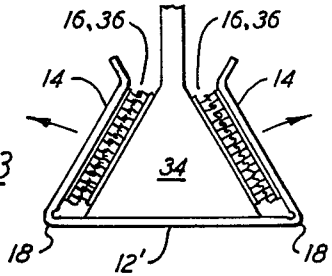
FIGS. 13 and 14 show alternative cross-sections for the channels of FIGS. 1 and 2.
Figure 14:
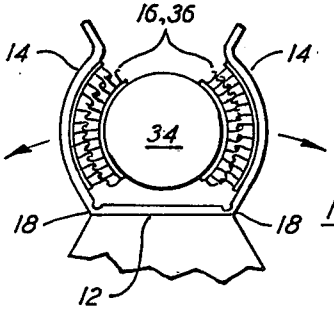

FIGS. 13 and 14 show exemplary alternative cross-sections for the channels of FIGS. 1 and 2 for use relative respectively to supports of triangular and circular cross-section.

As will be appreciated by those of ordinary skill in this technology, many variations of article organizers using the inventive concept of the present application are possible without departing from that concept even though they do not precisely follow the various embodiments hereinbefore described.

For example, the base 28 and support post 30 may be adapted for mounting from a wall (or other vertical surface) or for support by or between ceiling and floor (or other horizontal surfaces). Also, the location of the hook material in the channel and loop material on the planar member could be reversed without adversely affecting performance.

A touch fastener, as used in this application, comprises a first planar backing material having a surface carrying hooks, mushrooms, balls on stems, pigtails, or the like, capable of engaging loops, hooks, mushrooms, balls on steams, pigtails, or the like, carried by a second planar backing material to releasably fasten components together. Terms herein referring to hook and loop fastening systems and parts thereof shall be construed to include other types of touch fasteners in which the fastening strength in shear (i.e. against forces applied in the plane of the fastener) substantially exceeds the fastening strength resisting peeling separation of the fastener by the application of force normal to the plane thereof.

Wherefore, having thus described by invention, I claim:

1. An article organizer characterized by:

(a) a central base;

(b) a mounting member carried by said central base;

(c) at least one article holder for releasably mounting on said mounting member by engagement of first and second components of a touch fastening system;

(d) one of said article holder and said mounting member carrying a hinged shear trap channel member comprising a rigid back portion interconnecting two rigid side portions defining inwardly facing surfaces, having the first component of the touch fastening system on each of said inwardly facing surfaces; at least one of said side portions being connected to said back portion by hinge means; the other one of said mounting member and said article holder carrying a self-supporting rigid unitary planar fin member defining parallel outwardly facing surfaces, having the second component of the touch fastening system on its parallel outwardly facing surfaces; said fin member being of a shape such that said shear trap channel is capable of surrounding the portion of said fin member carrying said touch fastener portions in a closely-fitting manner; said back portion of said hinged shear trap channel member being of a width such that said inwardly facing surfaces are substantially parallel to said outwardly facing surfaces upon engagement of said components of the touch fastening system, said width being sufficiently less than the combined height of said fin member and said touch fastener portions; whereby the fastener components act in shear to support said at least one article holder on said mounting member and said at least one side portion can be pivoted outwardly to effect progressive disengagement of the touch fastener components apart from one another when desired, whereby the engagement of said engaging elements of the mating portions of the touch fastening system position said fin member in said shear trap channel in substantially rigid parallel relation and confine said inwardly and outwardly facing surfaces in a substantially fixed space relationship, which space is sufficiently less than the combined height of the components of the touch fastening system, wherein said shear trap channel is configured to substantially surround at least a portion of said fin member, thereby creating the confinement of relative movement of said members and the progressive resistance of said engaging elements when said members are moved relative to each other, so that attachment and detachment of the respective members is achieved only by forces substantially parallel to the respective surfaces of said fastener members in sufficient magnitude to overcome the progressive resistance of the engaging elements progressively engaging and disengaging as they are moved relative to each other.

2. The article organizer of claim 1 characterized in that said central base supports a vertical post which carries said mounting member.

3. The article organizer of claim 2 characterized in that said central base, said vertical post and said mounting member are arranged to permit said mounting member to pivot about a vertical axis disposed longitudinally through said post.

4. The article organizer of claim 1 wherein said mounting member carries said hinged shear trap channel member and said at least one article holder carries said rigid unitary planar fin member.

5. The article organizer of claim 1 wherein said at least one article holder carries said hinged shear trap channel member and said mounting member carries said rigid unitary fin member.

6. The article organizer of claim 1 wherein said parallel outwardly facing surfaces of said fin member are oriented vertically and the back portion of said hinged shear trap channel member extends vertically to define vertically oriented inwardly facing surfaces capable of engaging said fin member.

7. The article organizer of claim 1 wherein said back portion of the hinged shear trap channel member is horizontally oriented so that the hinged shear trap channel member opens downwardly such that the back portion is upper-most with said inwardly facing surfaces vertically oriented and said fin member having vertically oriented parallel outwardly facing surfaces capable of being releasably engaged by said downwardly facing hinged shear trap channel member.

8. The article organizer of claim 1 wherein the touch fastening system comprises hook and loop fasteners.

9. The article organizer of claim 1 wherein said central base is a lazy-susan type disc for providing rotation of said mounting member.

10. The article organizer of claim 4 wherein said mounting member carries a plurality of hinged shear trap channel members, each said channel member having its back portion attached to said mounting member so as to define vertically oriented inwardly facing surfaces.

11. The article organizer of claim 5 wherein said mounting member carries a plurality of fin members extending outwardly from said mounting member and defining vertically oriented outwardly facing surfaces for engagement with said hinged shear trap channel member.

12. The article organizer of claim 1 wherein said mounting member includes at least one lazy-susan type disc mounted for rotation about said base member, said disc having a plurality of fin members extending upwardly tangentially about the periphery thereof and defining vertically oriented outwardly facing surfaces for engagement with said hinged shear trap channel member.

13. In a touch fastening system comprising two engaging portions carried by first and second members, respectively, for releasably fastening the first and second members together, the improvement characterized by:

(a) the first member carrying a hinged shear trap channel having a rigid back portion interconnecting a pair of rigid opposed side portions, defining inwardly facing surfaces, with a portion of the touch fastening system on each inward facing surface, said hinged shear trap channel having at least one if its side portions connected to said back portion by hinge means; and (b) the second member carrying a self-supportingly rigid unitary fin member defining opposed outwardly facing surfaces and having a cooperating portion of the touch fastener system on its opposed outwardly facing surfaces, said fin member being of a shape such that said shear trap channel is capable of surrounding the portion of said fin member carrying said touch fastener portions in a closely-fitting manner; whereby said hinged shear trap channel is capable of receiving said self-supportingly rigid unitary fin member between its inwardly facing surfaces with the two portions of the touch fasteners engaged in shear to support said second member to said first member, said rigid back portion being of a width such that the inwardly and outwardly facing surfaces are all substantially parallel to one another upon said engagement, and said at lease one hinged side portion provides progressive disengagement of the engaged touch fasteners when desired, whereby the engagement of said engaging elements of the mating portions of the touch fastening system position said fin member in said shear trap channel in substantially rigid parallel relation and confine said inwardly and outwardly facing surfaces in a substantially fixed spaced relationship, which space is sufficiently less than the combined height of the components of the touch fastening system, wherein said shear trap channel is configured to substantially surround at least a portion of said fin member, thereby creating the confinement of relative movement of said members and the progressive resistance of said engaging elements when said members are moved relative to each other, so that attachment and detachment of the respective members is achieved only by forces substantially parallel to the respective surfaces of said fastener members in sufficient magnitude to overcome the progressive resistance of the engaging elements progressively engaging and disengaging as they are moved relative to each other.

* * * * *